US006155182A

United States Patent [19]

Tsangaris et al.

[11] Patent Number: 6,155,182

[45] Date of Patent: Dec. 5, 2000

[54] PLANT FOR GASIFICATION OF WASTE

[76] Inventors: Andreas Tsangaris, 29 Confederation Private, Ottawa, Ontario, Canada, K1V 9W6; George W. Carter, 800 Chapman Blvd., Ottawa, Ontario, Canada, K1G 1T9

[21] Appl. No.: 09/287,772

[22] Filed: Apr. 7, 1999

Related U.S. Application Data

[63] Continuation-in-part of application No. 08/923,793, Sep. 4, 1997, abandoned.

[51] Int. Cl.[7] ..... F23G 5/027; F23G 5/10

[52] U.S. Cl. ..... 110/255; 110/229; 110/238; 110/242; 110/250; 219/121.37

[58] Field of Search ..... 110/346, 229, 110/235, 238, 242, 250, 255, 257, 259, 322, 323, 101 R; 219/121.37, 121.36, 121.44; 48/62 R, 74

[56] References Cited

U.S. PATENT DOCUMENTS

| | | | |
|---|---|---|---|
| 4,495,873 | 1/1985 | Blankenship | 110/250 |
| 4,989,522 | 2/1991 | Cline et al. | 110/250 |
| 5,062,372 | 11/1991 | Ritter | 110/242 |
| 5,095,828 | 3/1992 | Holden et al. | 110/250 |
| 5,101,739 | 4/1992 | Nance et al. | 110/229 |
| 5,280,757 | 1/1994 | Carter et al. | 110/346 |
| 5,288,969 | 2/1994 | Wong et al. | 110/250 X |
| 5,295,449 | 3/1994 | Maeda et al. | 110/229 |
| 5,319,176 | 6/1994 | Alvi et al. | 110/242 X |
| 5,361,709 | 11/1994 | Eshleman | 110/255 |
| 5,410,121 | 4/1995 | Schlienger | 219/121.36 X |
| 5,417,170 | 5/1995 | Eshleman | 110/250 X |
| 5,477,790 | 12/1995 | Foldyna et al. | 110/235 X |
| 5,877,394 | 3/1999 | Kujawa et al. | 219/121.37 X |
| 6,066,825 | 5/2000 | Titus et al. | 219/121.36 |

*Primary Examiner*—Ira S. Lazarus
*Assistant Examiner*—Ljiljana V. Ciric
*Attorney, Agent, or Firm*—Donald W. Margolis

[57] ABSTRACT

A waste disposal system for gasification and melting of various waste materials such as solid waste, waste in a solid container, granular waste, and liquid waste, and mixtures thereof. The system includes a reactor vessel which is closed to the atmosphere, and also includes a bottom portion capable of serving as a slag pool. An active feed mechanism eliminates the entry of air from the atmosphere into the vessel and also blocks the expulsion of by product gases into the atmosphere. The feed mechanism includes mechanisms to feed solid waste, waste in a solid container, granular waste and liquid waste into the reactor vessel. A plasma arc torch is located for plasma arc activity within said reactor vessel to produce a high temperature processing zone to gasify or melt solid waste, waste in a solid container, granular waste, and liquid waste and mixtures thereof as such waste is actively fed into the reactor vessel. In preferred embodiments a waste receiving reservoir is located within the vessel and positioned to initially receive and retain waste from the active feed mechanism for thermal decomposition and melting of the waste by the arc torch.

16 Claims, 5 Drawing Sheets

PLANT FOR GASIFICATION OF WASTE

RELATED APPLICATIONS

This application is a continuation-in-part of U.S. patent application Ser. No. 08/923,793 for PLANT FOR GASIFICATION OF WASTE, filed Sep. 4, 1997, and now abandoned.

BACKGROUND OF THE INVENTION

1. Field of the Invention

The present invention relates to a waste disposal plant and, in particular, to a waste disposal plant utilizing a plasma arc torch to dispose of solid waste, waste in a solid container, granular waste, liquid waste, and mixtures thereof.

2. Discussion of the Prior Art

The daily generation of solid wastes is a fact of life in industrialized society and their disposal is becoming an ever-increasing problem. In the search for non-polluting, more efficient and less costly disposal, energy from waste (EFW) technologies are being developed such as gasification by means of a plasma arc torch in an enclosed, refractory lined, reactor vessel.

Plasma gasification is a non-incineration thermal process which uses extremely high temperatures in an oxygen starved environment to completely decompose input waste material into very simple molecules. The extreme heat and lack of oxygen results in pyrolysis of the input waste material, as opposed to incineration of those materials. Pyrolysis is the thermal decomposition of matter in the absence of oxygen. The by-products of the pyrolysis process are usually a combustible gas and an inert slag.

The heat source in a plasma gasification system is a plasma arc torch, a device which produces a very high temperature plasma gas. The plasma arc centerline temperature can be as high as about 50,000° C., and the resulting plasma gas has a temperature profile of between about 3,000° and about 8,000° C.

A plasma gasification system is designed specifically for the type, size and quantity of waste material which must be processed. A refractory lined reactor vessel is preheated to a minimum wall temperature of approximately 1100° C. before any processing commences, the actual minimum ambient temperature being determined by the waste material being processed. The very high temperature profile of the plasma gas then provides an optimum processing zone within the reactor vessel through which all input waste material is forced to pass. The reactor vessel operates effectively at atmospheric pressure. In this environment, all of the volatile input material is completely decomposed, while non-volatile input material, such as glass, metals, dirt, sand and the like melt to form slag. When cooled the slag form an inert solid mass. Thus, pyrolysis through plasma gasification provides for virtual complete gasification of all volatiles in the source material, while non-combustible material is reduced to an inert slag.

With municipal solid waste as the input waste material, the product gas and slag have very distinct characteristics. The product gas is high in hydrogen and carbon monoxide, with traces of methane, acetylene and ethylene. Therefore, the product gas from the pyrolysis of municipal solid waste be combusted very efficiently resulting in carbon dioxide and water vapor constituting the majority of the gaseous combustion by-product that is exhausted to the atmosphere. The slag is typically a homogeneous, silico-metallic mass, which is monolithic in texture, and with leachate toxicity levels orders of magnitude lower than those of current landfill regulations.

Plasma gasification systems offer considerable versatility as to throughput capacity. Plasma arc torches are available commercially in sizes ranging from 50 KW to over 60 MW; therefore, plasma gasification systems can be implemented at virtually any size capacity. The reactor vessel and plasma arc torch are specifically sized to the type and quantity of waste material to be processed. There are many plasma arch torch manufacturers who could provide equipment for use in such systems. Individual torches can be selected to operate in particular waste processing applications where their operational capabilities can be best applied.

Applicants' U.S. Pat. No. 5,280,757 which was issued Jan. 25, 1994 describes plasma gasification of waste, and is incorporated herein by reference.

Alvi et al. (U.S. Pat. No. 5,319,176) teaches a system for plasma gasification of gas which is limited to only a liquid or granular waste stream. It does not teach material processing apparatus for processing a variety of waste material such as municipal solid waste, boxed biomedical waste, granular contaminated solid, and liquid toxic waste. In addition, it does not teach the use of a platform located within the reactor vessel for initially receiving and holding such waste from the feed mechanism for thermal decomposition of such waste while on the platform by a plasma arc torch. In addition, it does not teach a specific barrier system.

Eshleman (U.S. Pat. No. 5,417,170) teaches a material processing apparatus, it neither teaches nor suggests an active feed mechanism.

U.S. relating to waste disposal vessels are Cline, et al. (U.S. Pat. No. 4,989,522) and Holden et al. (U.S. Pat. No. 5,095,828). Other prior art patents relating to waste incineration and gasification plants are Blankenship (U.S. Pat. No. 4,495,873); Ritter (U.S. Pat. No. 5,062,372); Nance et al. (U.S. Pat. No. 5,101,739); Wong et al. (U.S. Pat. No. 5,288,969); Maeda et al. (U.S. Pat. No. 5,295,449); Eshleman (U.S. Pat. No. 5,361,709); Shlienger (U.S. Pat. No. 5,410,121); and Foldyna et al. (U.S. Pat. No. 5,477,790).

None of these references teaches a plasma arc gasification plant which is useful for efficiently and safely processing many kinds of waste, such as municipal solid waste, boxed waste, liquid waste and granular waste in a manner which avoids environmental contamination. None of these references teaches a plasma arc gasification plant having a platform located Kin the reactor vessel for initially receiving waste from the feed mechanism for thermal decomposition of such waste by a plasma arc torch. In addition, none of these references teaches a specific barrier system which is neither taught nor suggested by Alvi et al. By contrast, the present patent application, as amended, claims an active feed mechanism.

SUMMARY OF THE INVENTION

It is therefore an object of the present invention to provide a gasification plant which is useful for the processing of many kinds of waste, such as solid waste, boxed waste, liquid waste and granular waste in a manner which avoids environmental contamination while maintaining a safe environment.

It is another object of the present invention to provide such a gasification plant which is useful for the processing of many kinds of waste in an efficient and safe manner by receiving and holding the materials on a platform located within the reactor vessel for initially receiving waste from the feed mechanism.

In order to achieve these objects, the present invention provides a plasma arc gasification plant which can process many forms of solid and liquid waste such as, for example, solid type waste such as municipal solid waste, boxed-type waste such as hospital biomedical waste, granular type waste such as contaminated soil and liquid type waste such as PCB oils. Such waste materials may be more generically referred to as "solid waste, waste in a solid container, granular waste, and liquid waste, and mixtures thereof." Waste feed and processing mechanisms are provided to efficiently and safely process such wastes.

It has now been found that the manner in which the waste material is fed into the refractory lined reactor vessel can affect the efficiency of processing The feed systems also affect the possibility of environmental contamination by release of hazardous gas to the environment. Therefore, according to a broad aspect of the present invention, there is provided a plant for gasification of solid type waste such as municipal solid waste, boxed-type waste such as hospital biomedical waste, granular type waste such as contaminated soil, and liquid type waste such as PCB oils, and the like, comprising: a refractory lined reactor vessel; a plurality of feed mechanisms each adapted to feed a predetermined type of waste into the refractory lined reactor vessel with minimum ingestion of atmospheric air and no exhaust of gaseous product back into the environment; and a specially configured processing platform in the refractory lined reactor vessel for best and most complete processing of the waste.

In its preferred embodiment, the present system includes a plurality of separate feed mechanisms to accommodate solid type waste material such as municipal solid waste, boxed-type waste material such as hospital biomedical waste, granular waste material such as contaminated soil, and liquid type waste such as PCB oils. The separate feed mechanisms are each capable of preventing problematic amounts of air from entering the refractory lined reactor vessel along with waste material. The feed systems are also each capable of preventing the passage therethrough of gaseous by-products from the refractory lined reactor vessel to the environment.

The system includes a solid waste feed mechanism. The mechanism is useful for feeding any type of solid waste into the refractory lined reactor vessel for processing. The mechanism provides an access chute to the interior of the refractory lined reactor vessel having at least a pair of gas tight barriers. The first gas tight barrier is provided adjacent to the outboard end of the chute, while the second barrier is positioned in the chute, intermediate to the first barrier and the reactor vessel. The barriers act to provide a gas lock whereby atmospheric air and hazardous gases can be trapped and, if required, evacuated, thereby avoiding the passage of such gases along the chute between the plant exterior and the interior of the refractory lined reactor vessel during the feed process. The evacuation of the air or gases in the gas lock is carried out by a purging system which acts between the barriers. In addition, the solid waste feed mechanism is provided with a ram mechanism for forcing the waste along the chute and into the refractory lined reactor vessel. The ram mechanism provides a positive feed feature to guard against waste pluggage problems in the feeder. The ram mechanism is also constructed to ensure that no waste material can become trapped within, around or behind any portion of it to cause eventual feed or safety problems. The portion of the chute adjacent the refractory lined reactor vessel is formed to co-operate with the shape and position of the ram to allow the formation of an airtight section in the chute by compactable solid waste material. The section, when formed, acts in the same way as the second barrier against passage of heat and large quantities of gas. Thus, the formation of a section formed of compactable waste allows further wastes to be fed behind the section without activation of the second barrier.

A box feeder is also provided in the system of the present invention. Hospital biomedical waste is normally packaged in boxes. Since this waste material can be infectious, it is essential to input this waste to the refractory lined reactor vessel in as-received boxed form. This type of feeder ensures the continued integrity of the containment of the infectious material until the very last point before it is forcibly and irreversibly into the optimum reactor processing environment. This type of feeder can also accommodate solid objects, such as bones and containers, without sectiongage and the associated problems of clearing such a sectiongage if the material is infectious. Boxed biomedical waste often includes containers of liquid. If the liquid is not released from the containers prior to the containers being injected into a high temperature processing environment, the containers will burst inside the refractory lined reactor vessel causing a rapid expansion of gaseous product. The box feeder comprises a chute having a separate air lock chamber substantially as described with reference to the solid waste feed mechanism, but in which the chute is sized to accept boxes. Where required, the box feeder further comprises a means for forcing the box along the chute and into the refractory lined reactor vessel, for example a hydraulic ram, and a means for piercing the box and its enclosed materials in a manner which will break open any containers of liquid within the box. The box feeder can be a separate chute opening into the refractory lined reactor vessel or it can be incorporated into the solid waste feed chute. The box feeder is used in conjunction with the inboard barrier as described in the solid waste feeder so that at least three barriers are provided to guard against the ingestion of atmospheric air or the exhaust of gaseous product back into the environment. The third barrier level provides additional security since the biomedical waste boxes cannot provide an integral airtight section themselves.

To facilitate the processing of granular waste such as, for example, contaminated soil, a screw feed is provided. The screw feed is comprised of a spiral blade in a housing and is provided in association with an air lock chamber. The spiral blade is sized within the housing to provide sufficient clearance for the largest particle size which will be encountered to prevent jamming. The screw feed is positioned to input the materials into the refractory lined reactor vessel at the high temperature processing zone. In one embodiment, the screw feed is positioned outside the refractory lined reactor vessel to feed the material through a port positioned such that it drops directly into the high temperature processing zone. In another embodiment the screw feed is mounted to be retractably extendable into the refractory lined reactor vessel for input of waste.

A port is provided in the refractory lined reactor vessel which permits the insertion of a liquid waste feeder. The liquid waste feeder is a spray head which injects liquid wastes, for example by spraying or atomization. The spray head can be positioned to direct the wastes into the hottest portion of the high temperature processing zone produced by the plasma gas stream from the plasma arc torch. The liquid feed port can also function to inject steam into the refractory lined reactor vessel. The injection of steam into the refractory lined reactor vessel may enhance the processing of dry carbonaceous type waste material which is being fed into the refractory lined reactor vessel through another feeder mechanism.

Most waste materials will process very readily once introduced to the high temperature processing zone within the refractory lined reactor vessel. Normally, processing is efficient, even if the input waste material falls into the molten slag pool which is formed at the bottom of the refractory lined reactor vessel prior to it being fully gasified. However, some waste materials, particularly those which contain a high concentration of elemental carbon, are best treated if they are retained in a high temperature oxidizing environment until they are completely gasified.

As an improvement, in the plant of the present invention, a processing platform is formed within the refractory lined reactor vessel to receive and to retain the input waste material until gasification of volatile constituents and melting of non-volatile constituents is complete. In preferred embodiments the processing platform is formed by a flat section to receive and retain the waste for processing, a dam surrounding the flat section to ensure all waste remains on the flat section until it is fully processed and an inclined path for the slag to flow from the flat section of the platform through the dam and into an adjacent cup shaped molten slag pool area designed to receive and hold the slag prior to its extraction from the refractory lined reaction vessel. The processing platform operates such that the input waste is exposed directly to the hottest portion of the optimum processing zone so that all input constituents, including glass, dirt and metals, either gasify or melt, and the gaseous constituent exits the refractory lined reactor vessel through the gas exit and the molten solid constituent flows into the molten slag pool at the bottom of the refractory lined reactor vessel prior to its extraction from the refractory lined reactor vessel. Flow of the molten solid constituent away from the flat section of the processing platform and into the molten slag pool, ensures that the remaining unprocessed, material primarily un-reacted carbon, is continuously exposed to the desired high temperature processing environment. The incline of the path followed by the molten solid constituent as it travels to the molten slag pool is maintained at less than two degrees to ensure that the molten solid constituent does not carry any non-molten constituents with it into the molten slag pool where these non-molten constituents may not fully undergo pyrolysis. This also ensures the most complete decomposition of the input waste to provide a full precaution to prevent airborne carry over of semi-processed material into downstream equipment at which they could settle and eventually cause pluggage.

A continuously operating plasma gasification plant requires the removal of slag from the refractory lined reactor vessel during processing without any adverse impact on the overall efficiency of the process. A means for allowing the molten slag to flow from the refractory lined reactor vessel during processing, without opening of the refractory lined reactor vessel to the ambient environment and thereby maintaining the integrity of the process and preventing the ingestion of atmospheric air, is provided.

The input of waste material into the refractory lined reactor vessel in discrete quantities causes fluctuations in the rate of generation of gaseous product which in turn can cause fluctuations in the pressure within the refractory lined reactor vessel. Maintenance of atmospheric pressure is desired to maintain the efficiency of the system and prevent the pushback of gas into the environment. For example, these fluctuations can be quite dramatic in the processing of boxed material such as biomedical waste, which can contain large concentrations of plastics and cellulosic material. The product gas handling system of the present plant is responsive to such fluctuations in product gas flow to maintain atmospheric pressure within the processing vessel. A variable speed plasma arc induction system has been provided which is responsive to fluctuations in the rate of generation of product gas.

The present invention is designed to provide the most complete processing environment for any input waste stream, including the complete breakdown of higher order gaseous polluting compounds. Substantial actual testing has confirmed less than 0.1% volatile constituents remaining in the molten slag by products.

These and other objects of the present invention will become apparent to those skilled in the art from the following detailed description, showing the contemplated novel construction, combination, and elements as herein described, and more particularly defined by the appended claims, it being understood that changes in the precise embodiments to the herein disclosed invention are meant to be included as coming within the scope of the claims, except insofar as they may be precluded by the prior art.

BRIEF DESCRIPTION OF THE DRAWINGS

The accompanying drawings illustrate complete preferred embodiments of the present invention according to the best modes presently devised for the practical application of the principles thereof and in which.

DETAILED DESCRIPTION OF THE PREFERRED EMBODIMENTS

Figure 1A:
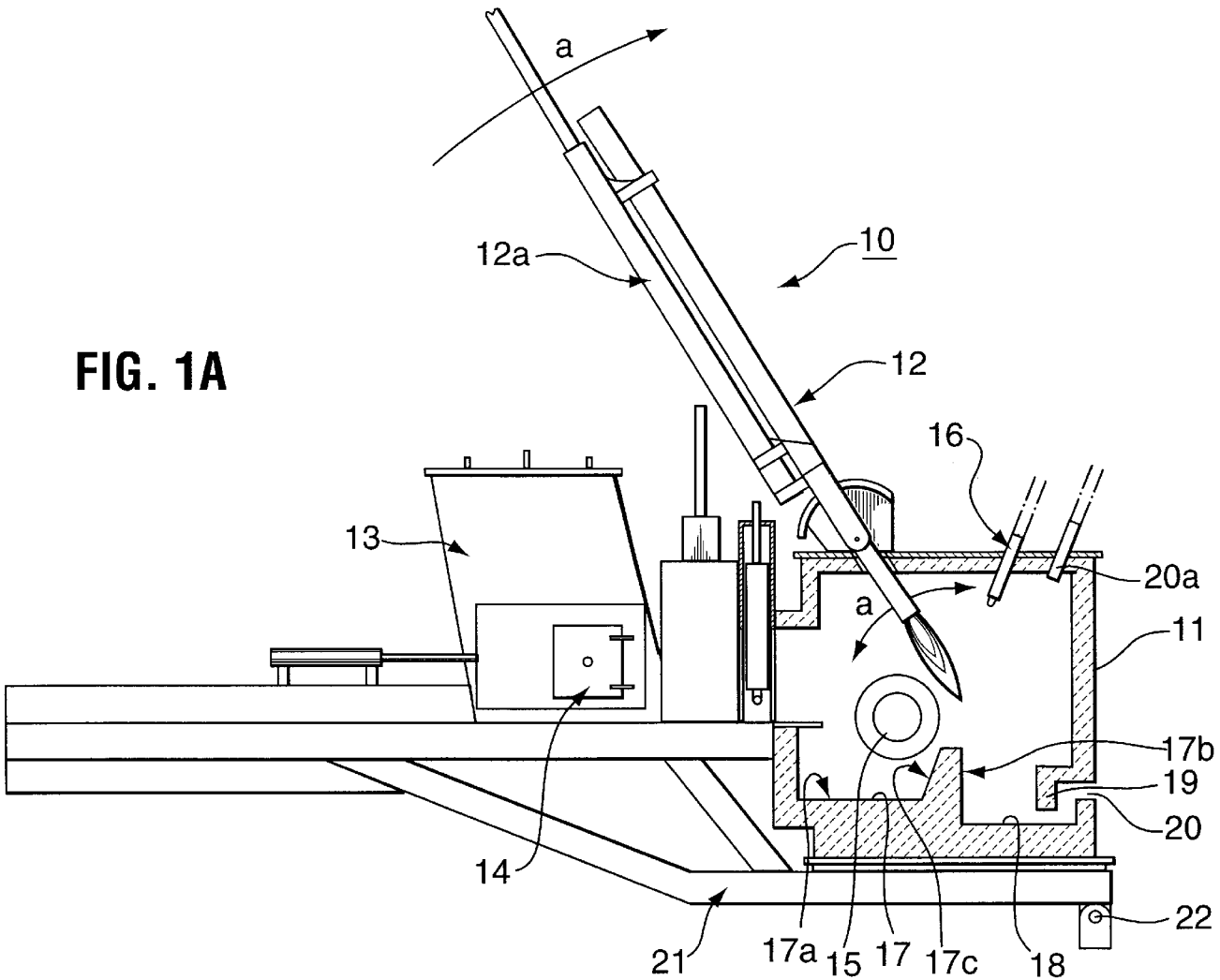
FIG. 1A is a side elevational schematic view of a plant according to the present invention, with a side wall of the refractory lined reactor vessel cut away to expose the refractory lined reactor vessel interior.
Figure 1B:
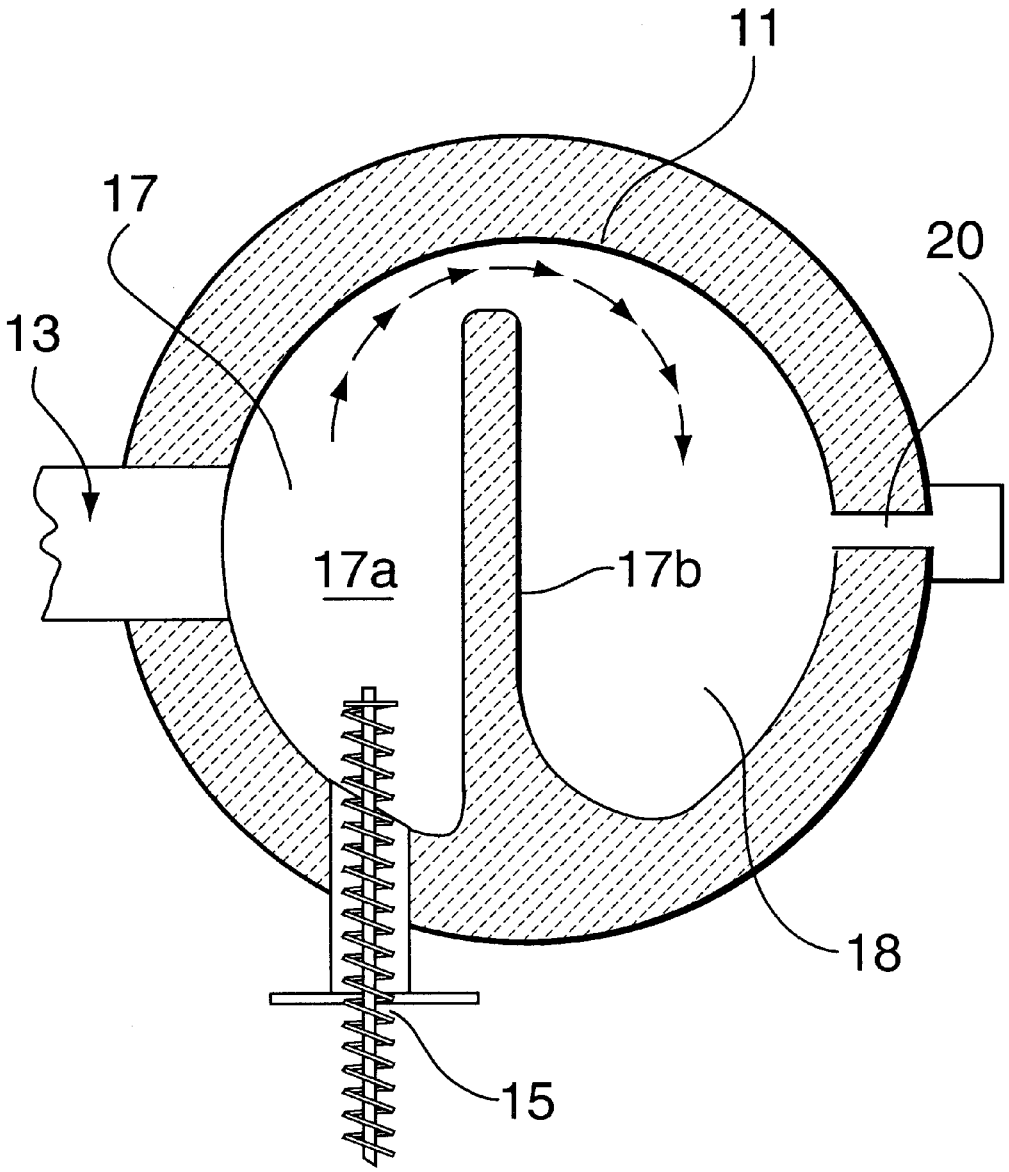
FIG. 1B is an enlarged plan sectional view of a refractory lined reactor vessel useful in the present invention.

Referring now to FIGS. 1A and 1B of the drawings, a side elevational view of a gasification plant 10 according to the present invention is shown. Plant 10 has a refractory lined reactor vessel 11 which has been cut away to reveal the interior thereof Refractory lined reactor vessel 11 houses a plasma arc torch 12 for the generation of a high temperature optimum processing zone for the gasification of waste introduced thereto by means of a plurality of waste feed mechanisms. Mechanism 12*a* supports the plasma arc torch 12 and permits rotational movements to change the focal point of the hot plasma gases from the plasma arc torch for optimization of the processing effect.

The waste feed mechanisms include: a solid waste feed mechanism, indicated generally at 13; a boxed waste feed mechanism, indicated generally at 14; a granular waste feed mechanism, indicated at 15 and a liquid waste feed mechanism, indicated generally at 16. Mechanisms 13, 14 and 15 feed the waste onto a processing platform 17, within refractory lined reactor vessel 11, such that it is directly in the optimum processing zone developed by the plasma arc torch. Processing platform 17 is formed by a flat section 17*a*, a raised dam 17*b* and an incline 17*c* sufficient to cause the molten slag, resulting from processing, to flow away from flat section of platform (17*a*), as indicated by arrows, and toward a semi-circular cup shaped reservoir 18 where a molten slag pool forms, occupying 40–50% of the floor area within the refractory lined reactor vessel. A weir 19 is provided at a slag exit port 20 which provides for removal of molten slag during processing without opening of refractory lined reactor vessel 11 to the ambient surrounding air environment. A gas exit port 20*a* is provided as an exhaust for gases. The plant is substantially completely gas-tight when in use with the orgy access to the refractory lined reactor vessel being by the feed mechanisms and the exit ports, which are sealable.

Plant 10 is mounted on a platform 21, which is hydraulically tiltable about pivotal connection 22 for emptying all or a portion of the molten slag, as required, after completion of a gasification process or on discrete intervals at the discretion of the operator depending on the volume of molten slag being produced from the input waste stream.

Figure 2:
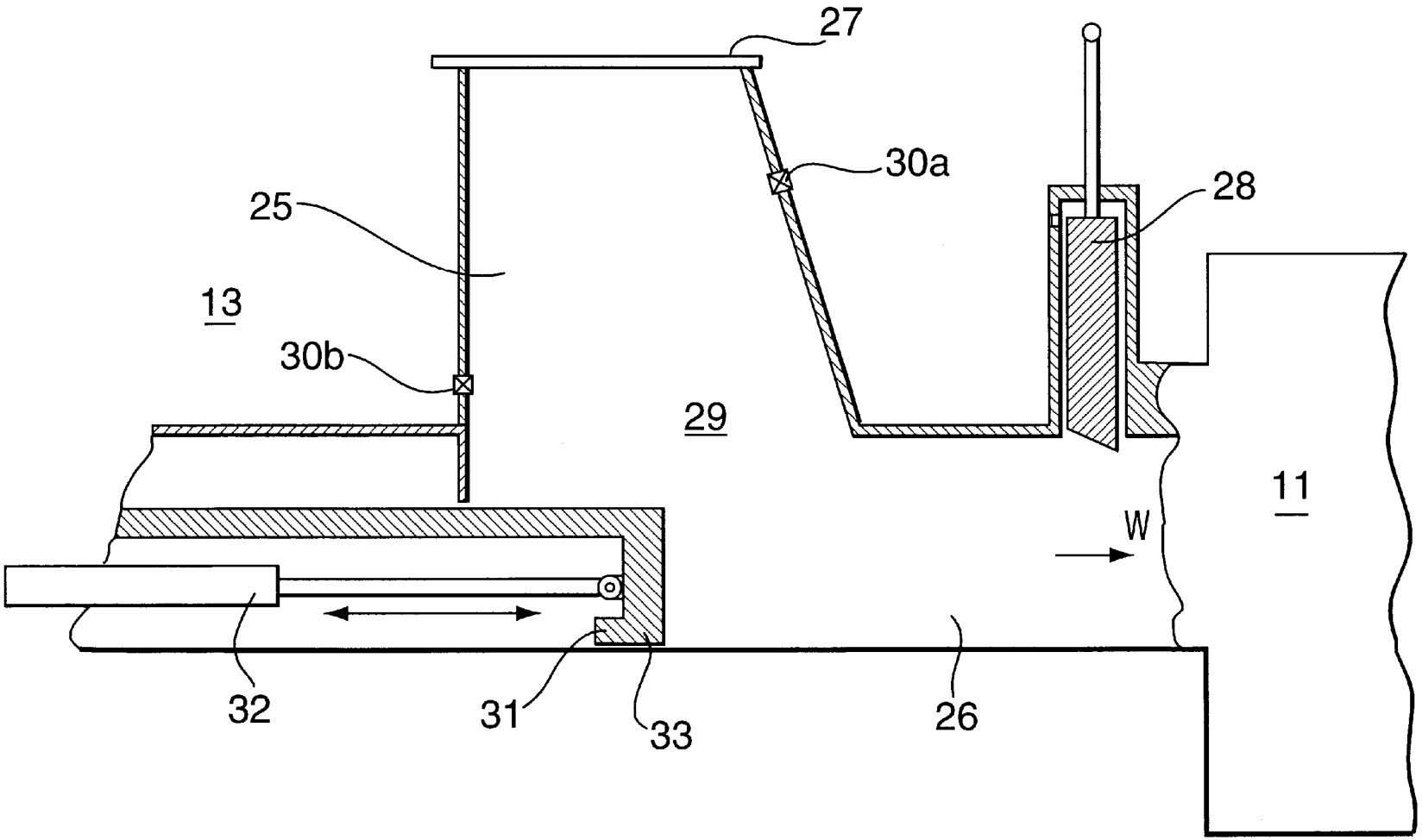
FIG. 2 is an enlarged side sectional schematic view of a solid waste feed mechanism useful in the present invention.

Referring to FIG. 2, solid-type waste feed mechanism 13 is shown in greater detail. Mechanism 13 comprises a feed-hopper 25 which opens into a chute 26, which in turn opens into refractory lined reactor vessel 11. Feed-hopper 25 diverges slightly as it opens into chute 26 to prevent blockage. A gas-tight door 27 is provided at the outboard end of hopper 25 and a hydraulically-driven, heat resistant, and preferably gas-tight, gate 28 is provided in chute 26. When door 27 is closed and gate 28 is in its lowered position, a heat and gas lock chamber is formed therebetween. Chamber 29 can be purged through valves 30*a*, 30*b* to prevent passage of air or gases between the atmosphere and the refractory lined reactor vessel. Purged reaction process gas is returned to the refractory lined reactor vessel through lines (not shown), while air is vented to the atmosphere or into a combustion chamber as part of its excess air supply.

Still referring to FIG. 2, a ram 31 is provided to move waste along chute 26. Ram 31 is driven by hydraulic mechanism 32. The crosshatched shield 33 provides a complete cover of ram 31 which is sized horizontally to fit snugly within chute 26; shield 33 and horizontal snug fit being specifically designed to prevent waste from falling behind and around the front face of the ram into hydraulic mechanism 32. Hydraulic mechanism 32 is enclosed by a gastight housing and is actuated by a power source having controls such as limit switches. The limit switches control the length of the ram's stroke, to thereby control the amount of waste fed to the refractory lined reactor vessel with each stroke.

In use, waste is input to feed-hopper 25 while ram 31 is in the retracted position and gate 28 is in its lowered heat and gas-tight position. Door 27 is then closed and atmospheric air is purged from the mechanism with nitrogen gas through valves 30*a* and 30*b*. Gate 28 is then raised to permit the waste to be moved along chute 26 by action of ram 31 and into refractory lined reactor vessel 11, as indicted by arrow W. Art known relief valves, not shown, can also be provided to prevent a build up of pressure in the hopper beyond safe levels.

When the waste is fully input to refractory lined reactor vessel 11, gate 28 is again lowered and the gases are purged, thereby allowing door 27 to be opened without releasing hazardous gases to the environment.

In the embodiment shown in FIG. 2, ram housing 33 can be formed such that, when ram 31 is activated, it co-operates with the cross-sectional shape of chute 26 to allow the formation of a section of compacted waste along the horizontal length of chute 26 and directly below gate 28 from which time gate 28 can remain in the retracted position. Once such a section is formed, the section will act as a heat and gas-tight barrier, in the same way as gate 28 and allow purging of gas behind the section and opening of door 27. Such a system allows for continuous feeding of waste to the hopper as long as a complete plug remains in chute 26 and prevents the ingestion of atmospheric air into the refractory lined reactor vessel and the exhaust of gas from the refractory lined reactor vessel back into the hopper and potentially into the environment. To ensure a better heat and gas-tight condition, gate 28 can be lowered on top of the plug.

Figure 3A:
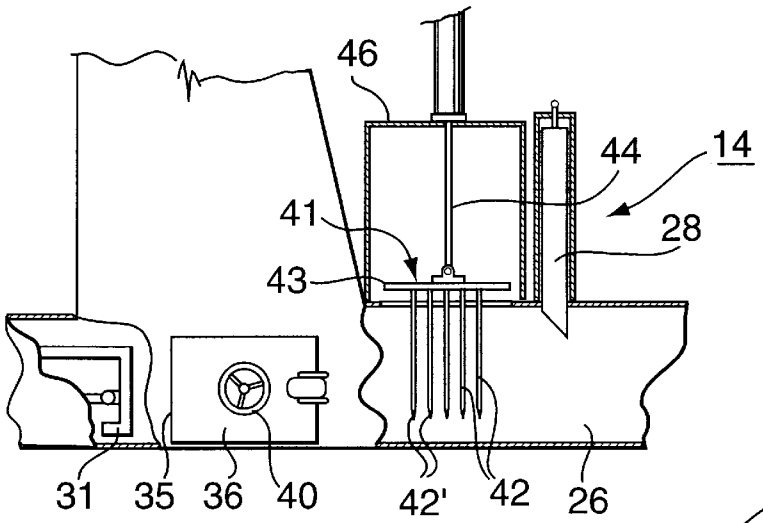
FIGS. 3A and 3B are side sectional and plan schematic views, respectively, of a boxed waste feed mechanism useful in the present invention.
Figure 3B:
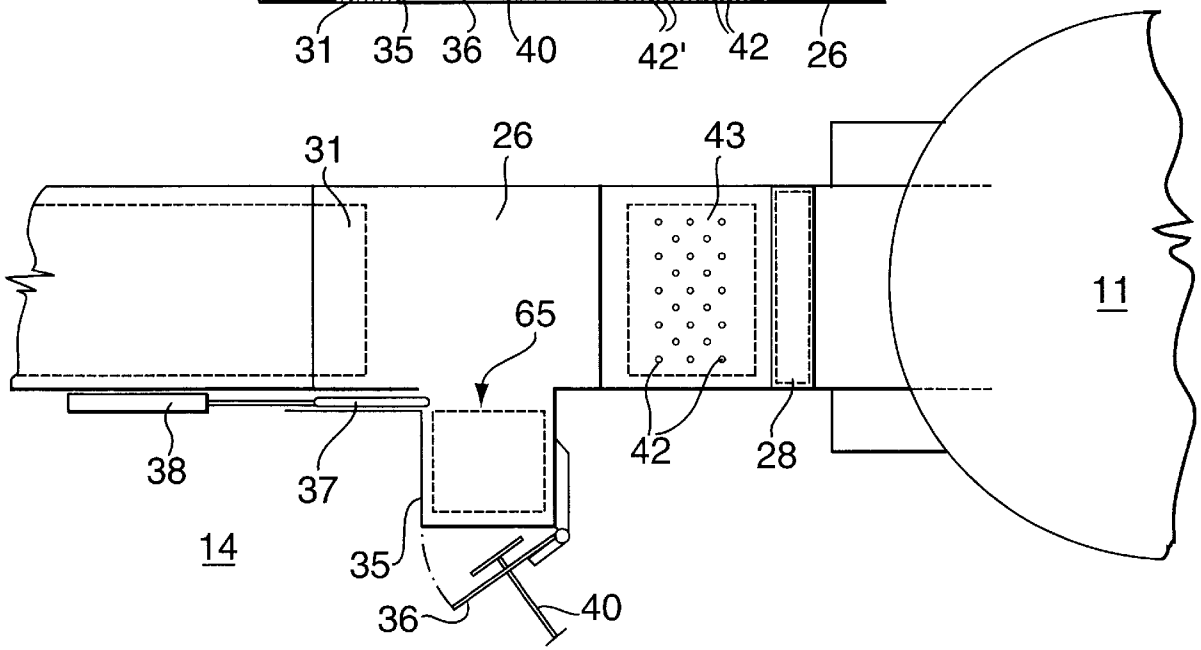

Referring to FIGS. 3A and 3B, an embodiment of boxed waste feed mechanism 14 is shown. Mechanism 14 comprises a box feed chamber 35 which opens into a feed chute 26. Chute 26 in turn opens into refractory lined reactor vessel 11. In the embodiment, as shown, box feed mechanism 14 is associated with the solid waste feed mechanism and chamber 35 is mounted at a side of chute 26. Chamber 35 has a gas-tight door 36 through which boxes can be fed to chamber 35. A gas tight gate 37 separates chamber 35 from chute 26. Gate 37 is actuated by an air or hydraulic mechanism 38 between an open position (as shown in FIG. 3B) and a closed, gas-tight position. When door 36 is closed and gate 37 is in its gas-tight position, a gas lock is formed in chamber 35. A plunger 40 is provided to move the boxed waste from chamber 35 into chute 26. Ram 31 moves boxed along chute 26 and into refractory lined reactor vessel 11.

In the preferred embodiment, as shown in FIGS. 3A and 3B, a box piercing apparatus 41 is mounted in chute 26 to be actuated to pierce a box 65 and its contents to break open any containers therein. Apparatus 41 comprises a plurality of stainless steel piercing rods 42 having sharpened tips 42 mounted on a moveable base 43. Base 32 is connected to the shaft 44 of a hydraulic mechanism 45. Apparatus 41 is enclosed in a gas-tight housing 46.

In use, gate 37 is closed and boxed waste is input to chamber 35 through door 36. Door 36 is then closed and sealed. To avoid the requirement for a purging system, preferably chamber 35 is sized to correspond to the shape and size of the boxed waste to be introduced so that substantially all of the atmospheric air is forced from the chamber by input of a box. Alternately, a purging system can be installed in chamber 35 and used after sealing of door 36 to remove atmospheric air. Gate 37 is then opened and plunger 40 is actuated to move the box into chute 26. Plunger 40 is retracted and gate 37 is closed. Hydraulic ram 31 is actuated to move the box into alignment with piercing apparatus 41. Base 43 of apparatus 41 is lowered such that rods 42 pierce the box and its contents. Apparatus 41 is thereafter raised and gate 28 is opened to allow ram 31 to move the box 65 along chute 26 and into refractory lined reactor vessel 11. Ram 31 is then retracted, gate 28 is closed and the feed process can be repeated as required. After a box 65 is fed into the refractory lined reactor vessel any residual gases in chamber 35 can be purged with nitrogen into feed chute 26 with gate 27 open where subsequently they will enter the refractory lined reactor vessel for processing on the next feed cycle. In this embodiment, gate 28, door 36, and gate 37 form a three barrier precaution mechanism to prevent the ingestion of atmospheric air into the refractory lined reactor vessel and the exhaust of gas products from the feed chute 26 and the refractory lined reactor vessel back into the environment since the waste boxes cannot form a waste plug in chute 26 in the same manner which the compacted waste plug is formed in the solid type waste feed mechanism. The three barrier system provides an extra level of precaution against the exhaust of infectious gases back into the environment when the biomedical waste boxes are pierced by apparatus 41 in chute 26, before the infectious waste is fully input into the refractory lined reactor vessel and the infectious gases are destroyed by the high temperature processing environment therein.

Figure 4:
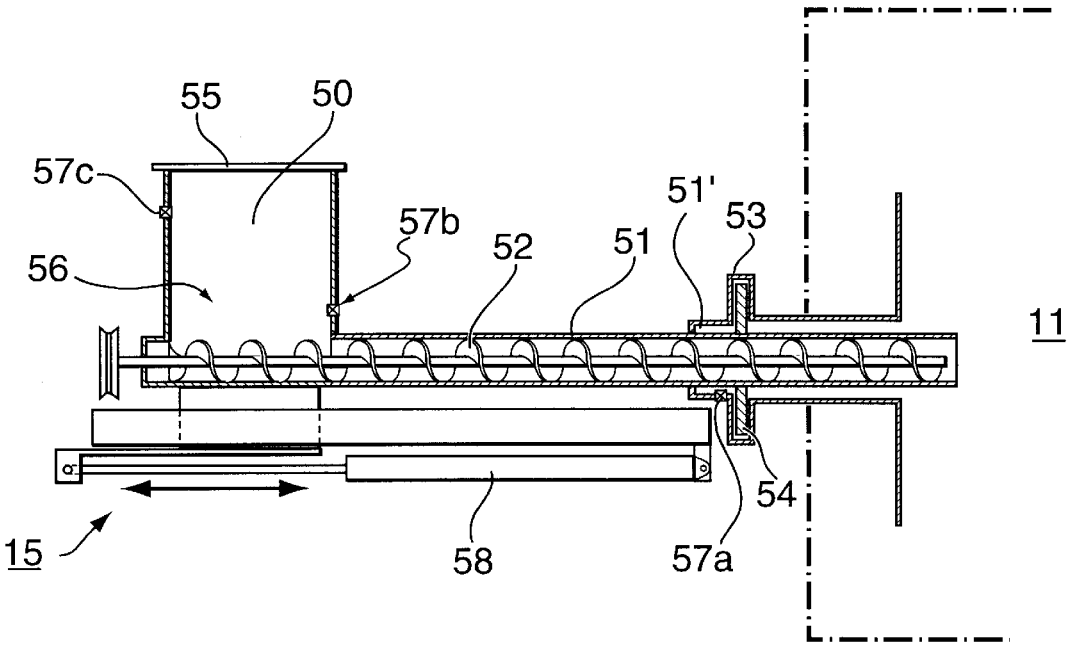
FIG. 4 is a side section schematic view of a granular waste feed mechanism useful in the present invention.

Referring now to FIG. 4, an embodiment of a granular waste feed mechanism 15 is shown. Mechanism 15 comprises a feed hopper 50 which opens into a tube 51 housing a rotatable spiral blade 52. Spiral blade 52 has sufficiently small diameter, when compared with that of tube 51 to prevent jamming of waste. The clearance between the spiral blade and the tube housing can be determined by the maximum granule size of the input waste. A housing 53 is sealably mounted about an end 51' of tube 51. Housing 53 opens into refractory lined reactor vessel 11 and has mounted therein a gas-tight, heat resistant gate 54. Gate 54 is hydraulically driven between an open position and a gas-tight sealed position. A gas-tight door 55, disposed on the outboard end of feed-hopper 50, acts with gate 54 to form a gas-lock chamber 56 therebetween which can be purged by use of valves 57*a*, 57*b* and 57*c*.

Mechanism 15 is adapted to feed the waste directly to the flat portion of the processing platform in the processing zone of the refractory lined reactor vessel by insertion of tube 51 into refractory lined reactor vessel 11. Tube 51 is slidably moveably within housing 53 between a position wherein tube 51 is retracted from refractory lined reactor vessel 11 and gate 54 can be closed and a position, as shown in FIG. 4, wherein a portion of tube 51 extends within refractory lined reactor vessel 11. Tube 51 is driven by a hydraulic mechanism 58.

In use, with mechanism 15 filly retracted from refractory lined reactor vessel 11, gate 54 and door 55 are sealed and shaft 51 and chamber 56 are purged with nitrogen by use of valves 57*a* and 57*c*. Door 55 is opened and granular waste is fed to feed-hopper 50. The waste drops down by gravity into tube 51 and about blade 52. Door 50 is then closed and chamber 56 is purged with nitrogen by valves 57*b* and 57*c*. Gate 54 is opened and hydraulic mechanism 58 is actuated to drive tube 51 within housing 53 and past gate 54 to extend into refractory lied reactor vessel 11. Spiral blade 52 is then actuated to rotate within tube 51 to carry the waste along tube 51 and input it to refractory lined reactor vessel 11. When desired, rotation of blade 52 is stopped and tube is retracted from refractory mined reactor vessel 11 and past gate 54 by hydraulics 58. Gate 54 is then closed and the process can be repeated.

Figure 5:
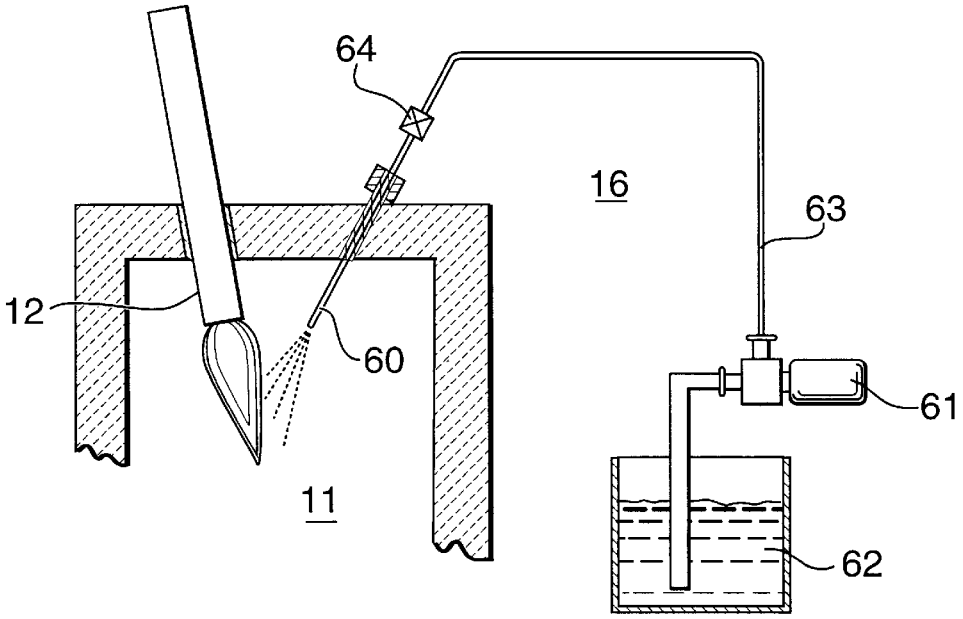
FIG. 5 is a side section schematic view of a liquid waste feed mechanism useful in the present invention.

Referring to FIG. 5, a feed mechanism 16 for liquid waste is shown. Mechanism 16 comprises a spray nozzle 60 for injecting (i.e., spraying or atomizing) liquids. Liquids are fed by a pump 61 to nozzle 60 from reservoir 62 through lines 63. The rate of liquid spray can be controlled by adjustment of valve 64. Nozzle 60 is preferably positioned in refractory lined reactor vessel 11 such that the liquid is fed directly into the high temperature processing zone produced by the plasma arc torch 12.

When liquid waste is not being handled, steam can be fed through nozzle 60 to assist in the processing of dry carbonaceous waste.

The mechanisms for feeding solid waste, boxed waste, granular waste and liquid waste, as described, need not all be present in the same plant, as the presence of more than one may not be required for the particular processing of waste being undertaken. Alternately, the mechanisms can all be present in the plant at all times, but only be used as needed.

The foregoing exemplary descriptions and the illustrative preferred embodiments of the present invention have been explained in the drawings and described in detail, with varying modifications and alternative embodiments being taught. While the invention has been so shown, described and illustrated, it should be understood by those skilled in the art that equivalent changes in form and detail may be made therein without departing from the true spirit and scope of the invention, and that the scope of the present invention is to be limited only to the claims, except as precluded by the prior art. Moreover, the invention as disclosed herein, may be suitably practiced in the absence of the specific elements which are disclosed herein.

We claim:

1. A waste disposal system for gasification and melting of waste materials, said waste disposal system nominally in contact with the ambient atmosphere and comprising:

a single oxygen-starved closed reactor vessel contained within said waste disposal system, said reactor vessel substantially closed to the ambient atmosphere, said reactor vessel including a bottom portion capable of serving as a slag pool;

an active feed mechanism operatively connected to said reactor vessel, said feed mechanism including barrier means for substantially eliminating the inflow of air from the ambient atmosphere into said reactor vessel and for blocking the expulsion of reactor vessel byproduct gases into the ambient atmosphere, said active feed mechanism including at least one feed component selected from the group consisting of feed components adapted to actively feed solid waste into said reactor vessel, feed components adapted to actively feed waste in a solid container into said reactor vessel, feed components adapted to actively feed granular waste into said reactor vessel, and feed components adapted to actively feed liquid waste into said reactor vessel;

a plasma arc torch operatively connected to said reactor vessel, said plasma arc torch located for plasma arc activity within said reactor vessel to produce a high temperature processing zone to gasify or melt any waste which is actively fed into said zone; and at least one waste-receiving reservoir located within said reactor vessel, each said waste-receiving reservoir being positioned to initially receive and retain any waste which is actively fed to said reservoir for thermal decomposition and melting of such waste by said plasma arc torch, said waste receiving reservoir comprising a substantially flat receiving platform and a dam at least partially surrounding said substantially flat-platform.

2. The waste disposal system of claim 1 wherein there is an opening in said dam and an inclined path through said opening in said dam to permit any melted waste components or byproducts to move to the bottom of said reactor vessel to form a slag pool.

3. The waste disposal system of claim 2 wherein said inclined path through said opening in said dam has a slope of two degrees or less.

4. The waste disposal system of claim 1 wherein said reactor vessel is lined with refractory material.

5. The waste disposal system of claim 1 wherein said active feed mechanism includes an elongated fluid-tight chute having a first end outboard to and remote from said reactor vessel and a second end opening into said reactor vessel, and wherein further said active feed mechanism includes means for both substantially eliminating inflow of air from the ambient atmosphere into said reactor vessel and for blocking the expulsion of reactor vessel byproducts into the ambient atmosphere.

6. The waste disposal system of claim 5 wherein said barrier means for both substantially eliminating the ingestion of air from the ambient atmosphere into said reactor vessel and for blocking the expulsion of reactor vessel byproducts into the ambient atmosphere includes a first fluid-tight barrier and a second fluid-tight barrier within said chute, said first fluid-tight barrier being located adjacent to said first end outboard to and remote from said reactor vessel, and said second fluid-tight barrier being located within said chute intermediate said first fluid-tight barrier and said second end chute opening into said reactor vessel to thereby provide a gas lock whereby ambient atmospheric air and hazardous gases can be trapped between said first fluid-tight barrier and said second fluid-tight barrier.

7. The waste disposal system of claim 6 wherein means are provided for evacuating any ambient atmospheric air and hazardous gases trapped between said first and second fluid-tight barriers.

8. The waste disposal system of claim 6 wherein means are provided for purging ambient atmospheric air and any hazardous gases produced within the reactor vessel and then trapped between said first and second fluid-tight barriers.

9. The waste disposal system of claim 5 wherein said active feed mechanism for solid waste and waste in solid containers includes a ram mechanism for forcing solid waste along the chute and into the reactor vessel.

10. The waste disposal system of claim 5 wherein said active feed mechanism for granular waste includes a screw feed for forcing granular waste along the chute and into the reactor vessel.

11. The waste disposal system of claim 10 wherein said screw feed forces granular waste onto said substantially flat receiving platform.

12. The waste disposal of claim 10 wherein said screw feed includes a spiral blade in a housing, said screw feed being operably connected with a feed hopper, said spiral blade being sized to provide sufficient clearance within said housing for the largest particle size which may be encountered to prevent jamming.

13. The waste disposal system of claim 12 wherein said screw feed housing and said feed hopper have a first end outboard of and remote from said reactor vessel and a second end opening into said reactor vessel, and wherein further said screw feed housing and said feed hopper include a gas-tight door and a gas-fight and heat resistant gate to form a gas-lock chamber, said gastight door being disposed on said outboard end of said feed hopper, and said gas-tight, heat resistant gate being located adjacent to said second end opening into said reactor vessel.

14. The waste disposal system of claim 12 wherein means are provided for purging said screw feed housing and said feed hopper gas-lock chamber with nitrogen.

15. The waste disposal system of claim 5 wherein said active feed mechanism for liquid waste includes a port located within the reactor vessel which permits the insertion of a liquid waste feeder including a spray head for injecting liquid waste by spraying or atomization into the reactor vessel.

16. The waste disposal system of claim 5 wherein said elongated gas-tight chute includes means for piercing solid containers to break any containers of liquid within the solid containers prior to the containers of liquid being inserted into said reactor vessel.

* * * * *